US010779613B2

(12) United States Patent
Yahata et al.

(10) Patent No.: US 10,779,613 B2
(45) Date of Patent: Sep. 22, 2020

(54) SOLE STRUCTURE AND SHOE INCLUDING SAME

(71) Applicant: Mizuno Corporation, Osaka (JP)

(72) Inventors: Kentaro Yahata, Osaka (JP); Kazunori Iuchi, Osaka (JP)

(73) Assignee: Mizuno Corporation, Osaka (JP)

( * ) Notice: Subject to any disclaimer, the term of this patent is extended or adjusted under 35 U.S.C. 154(b) by 28 days.

(21) Appl. No.: 16/244,322

(22) Filed: Jan. 10, 2019

(65) Prior Publication Data

US 2019/0216169 A1 Jul. 18, 2019

(30) Foreign Application Priority Data

Jan. 16, 2018 (JP) ..... 2018-004771

(51) Int. Cl.

| | |
|---|---|
| ***A43C 15/00*** | (2006.01) |
| ***A43B 13/14*** | (2006.01) |
| ***A43B 13/18*** | (2006.01) |
| ***A43B 13/20*** | (2006.01) |
| ***A43B 13/16*** | (2006.01) |
| ***A43B 13/22*** | (2006.01) |
| *A43B 7/14* | (2006.01) |

(Continued)

(52) U.S. Cl.

CPC ..... *A43B 13/146* (2013.01); *A43B 13/16* (2013.01); *A43B 13/18* (2013.01); *A43B 13/184* (2013.01); *A43B 13/20* (2013.01); *A43B 13/223* (2013.01); *A43C 15/00* (2013.01); *A43B 7/144* (2013.01); *A43B 13/12* (2013.01); *A43B 13/127* (2013.01); *A43B 13/14* (2013.01); *A43B 13/183* (2013.01); *A43C 15/168* (2013.01)

(58) Field of Classification Search

CPC ..... A43B 13/18; A43B 13/184; A43B 13/20; A43C 15/00; A43C 15/02; A43C 15/14; A43C 15/168

USPC ..... 36/29, 59 R, 67 R, 59 A, 61, 59 C, 134

See application file for complete search history.

(56) References Cited

U.S. PATENT DOCUMENTS 1,539,283 A * 5/1925 Staats-Oels ..... A43B 21/26 36/29
1,563,098 A * 11/1925 Miller ..... A43B 21/28 36/59 C (Continued)

FOREIGN PATENT DOCUMENTS

JP S4932848 U 3/1974
JP S5660502 A 5/1981

(Continued)

OTHER PUBLICATIONS

Japanese Office Action issued in related application No. 2018-004771 dated Nov. 26, 2019.

*Primary Examiner* — Marie D Bays

(74) *Attorney, Agent, or Firm* — Troutman Pepper Hamilton Sanders LLP; James E. Schutz; Micah B. Hensley

(57) ABSTRACT

An outsole includes a substantially flat reference surface formed on a lower side of the outsole, and studs projecting downward from the reference surface and each having a projection surface positioned below the reference surface. Midsole hollows are provided in a lower portion of a midsole. The midsole hollows are each defined between an upper portion of the outsole and an associated one of midsole recesses formed in a lower surface of a lower midsole at positions facing upper sides of the studs.

4 Claims, 6 Drawing Sheets

(51) Int. Cl.
*A43C 15/16* (2006.01)
*A43B 13/12* (2006.01)

(56) References Cited

U.S. PATENT DOCUMENTS 2,853,809 A * 9/1958 Bianchi ..... A43B 13/223 36/59 C
4,083,125 A * 4/1978 Benseler ..... A43B 5/10 36/32 R
4,271,606 A * 6/1981 Rudy ..... A43B 13/223 36/29
4,358,902 A * 11/1982 Cole ..... A43B 13/206 36/28
RE34,102 E * 10/1992 Cole ..... A43B 13/203 36/28
5,768,802 A * 6/1998 Bramani ..... A43B 7/146 36/28
6,209,226 B1 * 4/2001 Squadroni ..... A43B 7/08 36/141
6,754,981 B1 * 6/2004 Edwards ..... A43B 7/144 36/29
7,316,081 B1 * 1/2008 Cheng ..... A43B 7/08 36/29
7,784,196 B1 * 8/2010 Christensen ..... A43B 13/184 36/29
9,439,474 B2 * 9/2016 Braunschweiler ... A43B 13/184
2004/0194343 A1 * 10/2004 Kim ..... A43B 7/08 36/29
2013/0263469 A1 10/2013 Braunschweiler
2013/0318828 A1 * 12/2013 Sink ..... A43B 13/14 36/103
2014/0196308 A1 * 7/2014 Baratta ..... A43B 13/184 36/29

FOREIGN PATENT DOCUMENTS

JP H07284403 A 10/1995
WO 2012045512 A1 4/2012

* cited by examiner

SOLE STRUCTURE AND SHOE INCLUDING SAME

CROSS-REFERENCE TO RELATED APPLICATION

This application claims priority to Japanese Patent Application No. 2018-004771 filed on Jan. 16, 2018, the entire disclosure of which is incorporated by reference herein.

BACKGROUND

The present disclosure relates to a sole structure and a shoe including such a sole structure.

For example, Japanese Patent No. 5797760 proposes a sole structure for athletic shoes.

Specifically, the sole structure disclosed in Japanese Patent No. 5797760 includes an outsole overlaid on the lower side of a midsole. This outsole includes a shoe sole surface and studs projecting downward from the shoe sole surface. Each stud includes, in its upper portion, a recess formed by recessing the upper surface of the outsole. Each recess and a lower portion of the midsole define a hollow space (hollow space 8) therebetween. The studs are movable in the vertical direction such that the hollow spaces deform in the vertical direction and the lower surfaces of the studs are aligned with the shoe sole surface.

SUMMARY

The sole structure of Japanese Patent No. 5797760 obtains cushioning properties through deformation of the stud (in particular, of the hollow space defined between the recess and the lower portion of the midsole). On the other hand, the lower surfaces of the studs are easily abraded due to contact with the ground. However, the recess, which is provided in the upper portion of each stud for the purpose of facilitating deformation of the stud in vertical direction, unavoidably restricts the thickness of the stud, making it difficult to ensure a sufficient thickness of the stud. As a result, the sole structure of Japanese Patent No. 5797760 is not able to reduce or prevent deterioration with age caused by, for example, the influence of abrasion of the studs.

In view of the foregoing background, the present disclosure attempts to reduce or prevent deterioration with age such as abrasion while maintaining appropriate cushioning properties.

A sole structure of the present disclosure and a shoe including the sole structure are capable of reducing or preventing deterioration with age such as abrasion while maintaining appropriate cushioning properties, through improvement of the configuration of a midsole.

Specifically, a first aspect of the present disclosure is directed to a sole structure. The sole structure includes a midsole made of an elastic material, and an outsole overlaid on a lower side of the midsole. The outsole includes a substantially flat reference surface formed on a lower side of the outsole, and a stud projecting downward from the reference surface and having a projection surface positioned below the reference surface. A midsole hollow is provided in a lower portion of the midsole, the midsole hollow defined between an upper portion of the outsole and a midsole recess formed in a lower surface of the midsole at a position facing an upper side of the stud.

According to the first aspect, each midsole hollow is provided directly above the associated one of the studs. This configuration enables each stud to move in the vertical direction toward the associated midsole hollow in response to an external force, such as a repulsive force from the ground, acting on the projection surface of the stud at a moment when the sole structure contacts the ground. As a result, the sole structure can exhibit cushioning properties. Unlike the known technique, according to the first aspect, it is unnecessary to form a recess, as an element enabling the stud to move in the vertical direction, in the upper surface of the outsole such that the recess is located in an upper portion of the stud. The thickness of each of the studs is therefore not particularly restricted. The studs can be formed to have a relatively large thickness, making it possible to reduce or prevent deterioration with age due to, for example, the influence of abrasion of the studs. As a result, the first aspect enables reduction or prevention of deterioration with age such as abrasion, while maintaining appropriate cushioning properties.

A second aspect of the present invention is an embodiment of the first aspect. In the second aspect, the stud is formed such that a surface area of the projection surface is smaller than an opening area of the midsole recess.

According to the second aspect, the projection surface comes close to the reference surface in response to an external force acting thereon, and the entire stud including the projection surface easily enters the associated midsole hollow. As can be seen, the vertical movement of the stud is facilitated, resulting in further improvement of the cushioning properties of the sole structure.

A third aspect of the present disclosure is an embodiment of the first aspect. In the third aspect, an outsole hollow is provided in an upper portion of the stud, the outsole hollow defined between a lower portion of the midsole and an outsole recess formed in an upper surface of the outsole, and the stud is configured to move, in response to an external force acting on the projection surface, in the vertical direction while the outsole hollow is compressively deformed and the projection surface comes close to the reference surface.

According to the third aspect, the vertical movement of the stud is facilitated by the compressive deformation of the outsole hollow, as compared to the first aspect. As a result, the cushioning properties of the sole structure can be further improved.

A fourth aspect of the present disclosure is an embodiment of the third aspect. In the fourth aspect, a midsole rib is provided in the midsole hollow, the midsole rib extending downward from a bottom of the midsole recess toward the outsole, and an outsole rib is provided in the outsole hollow, the outsole rib extending upward from a bottom of the outsole recess toward the midsole and being in contact with a lower end of the midsole rib.

The fourth aspect includes the midsole rib and the outsole rib. In a step of compression-bonding the outsole and the midsole together of a production process of the sole structure, these ribs can prevent the midsole hollow and the outsole hollow from being crushed unintentionally, thereby maintaining the internal spaces of these hollows.

A fifth aspect of the present disclosure is directed to a shoe including the sole structure of any one of the first to fourth aspects.

According to the fifth aspect, shoes can be provided which are as advantageous as the first to fourth aspects.

As can be seen from the foregoing description, the present disclosure can reduce or prevent deterioration with age such as abrasion, while maintaining appropriate cushioning properties.

DETAILED DESCRIPTION

Embodiments of the present disclosure will now be described in detail with reference to the drawings. Note that the following description of the embodiments is a mere example in nature, and is not intended to limit the scope, application, or uses of the present disclosure.

First Embodiment

Figure 1:
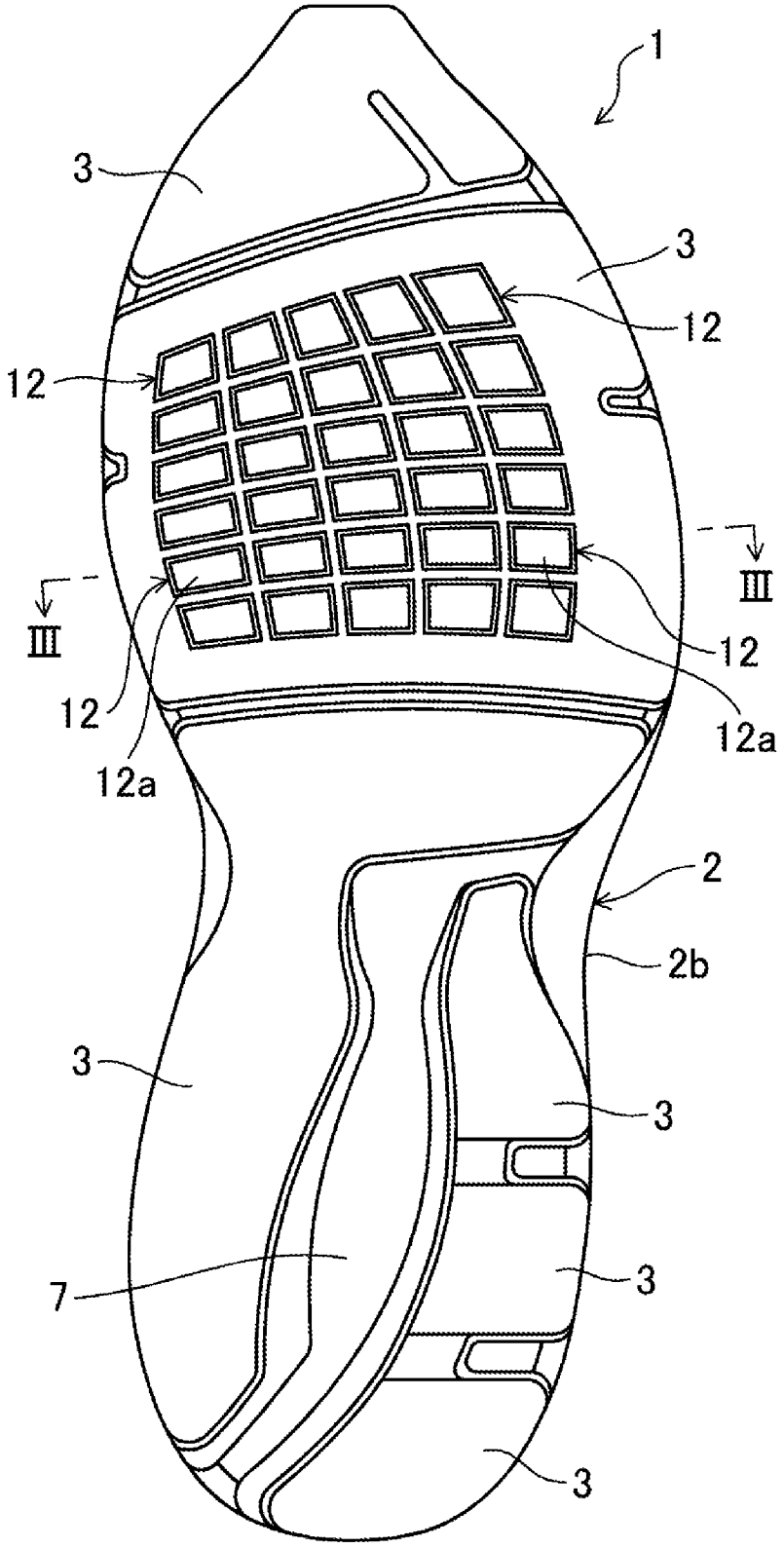
FIG. 1 is a bottom view of a sole structure according to a first embodiment of the present disclosure.
Figure 2:
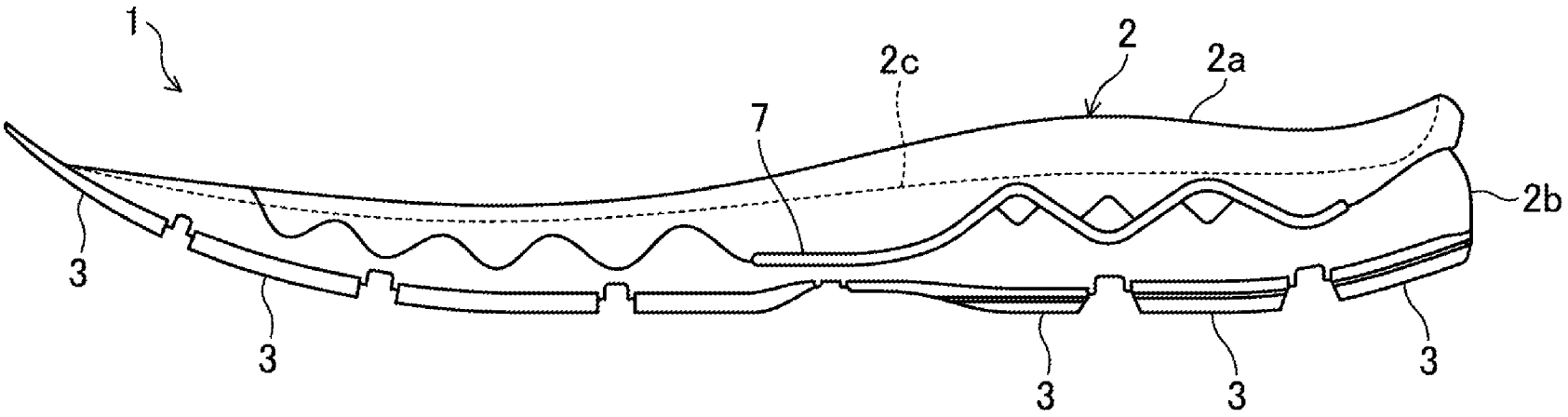
FIG. 2 is a side view of the sole structure, as viewed from a medial side.

FIGS. 1 and 2 illustrate the overall configuration of a sole structure 1 according to a first embodiment of the present disclosure. The sole structure 1 is configured to support a plantar surface of a wearer. A pair of shoes including the sole structure 1, a shoe upper (not shown) provided on the sole structure 1, and other components are usable as, for example, walking shoes, running shoes, shoes for indoor sports, and shoes for ball sports played on soil or turf.

The drawings show the sole structure 1 for a left shoe only. A sole structure for a right shoe is symmetrical to the sole structure 1 for the left shoe. In the following description, only the sole structure 1 for the left shoe will be described and the description of the sole structure for the right shoe will be omitted.

In the following description, the expressions "above," "upward," "on a/the top of," "below," "under," and "downward," represent the vertical positional relationship between components of the sole structure 1. The expressions "front," "fore," "forward, "rear," "back," "hind," "behind," and "backward" represent the positional relationship in the longitudinal direction between components of the sole structure 1.

As illustrated in FIGS. 1 and 2, the sole structure 1 includes a midsole 2 configured to support the entire plantar surface extending from a forefoot to a hindfoot, and outsoles 3, 3, . . . overlaid on the lower side of the midsole 2.

The midsole 2 is made of a soft elastic material. Non-limiting examples of the material suitable for the midsole 2 include thermoplastic synthetic resins such as ethylene-vinyl acetate copolymer (EVA) and foams of the thermoplastic synthetic resins, thermosetting resins such as polyurethane (PU) and foams of the thermosetting resins, and rubber materials such as butadiene rubber and chloroprene rubber and foams of the rubber materials.

The midsole 2 is comprised of two parts stacked together in the vertical direction. Specifically, the midsole 2 is a multilayer including an upper midsole 2*a* and a lower midsole 2*b* overlaid on the lower side of the upper midsole 2*a*.

In an upper portion of the upper midsole 2*a*, a planta support surface 2*c* configured to support a plantar surface extends in the longitudinal direction. A shoe upper (not shown) for covering the wearer's foot is attached to a peripheral portion of the upper midsole 2*a*.

The lower midsole 2*b* has midsole recesses 2*d*, 2*d*, . . . formed by recessing the lower surface of the lower midsole 2*b*. Each midsole recess 2*d* is formed at a position facing the upper side of an associated one of studs 12, which will be described later. Each midsole recess 2*d* is tapered upward from the lower surface of the lower midsole 2*b* in cross section. In a lower portion of the lower midsole 2*b*, midsole hollows 6, 6, . . . are provided. Each of the midsole hollows 6, 6, . . . is defined between an associated one of the midsole recesses 2*d*, 2*d*, . . . and an upper portion of the outsole 3.

A reinforcing plate 7 is disposed between the upper and lower midsoles 2*a* and 2*b* so as to correspond to the hindfoot of the wearer's foot. The reinforcing plate 7 is comprised of a thin layer which is harder than the upper and lower midsoles 2*a* and 2*b* and has a corrugated shape having projections and depressions alternating with each other in the longitudinal direction. Note that the reinforcing plate 7 is not limited to the corrugated shape, and may have a flat plate shape, for example.

The outsoles 3, 3, . . . are arranged over a region extending from the forefoot to the hindfoot of the wearer's foot. Each outsole 3 is made of a hard elastic material which is harder than the material for the midsole 2. Examples of materials suitable for the outsole 3 include, but not are limited to, thermoplastic resins such as ethylene-vinyl acetate copolymer (EVA), thermosetting resins such as polyurethane (PU), and rubber materials such as butadiene rubber and chloroprene rubber.

Figure 3:
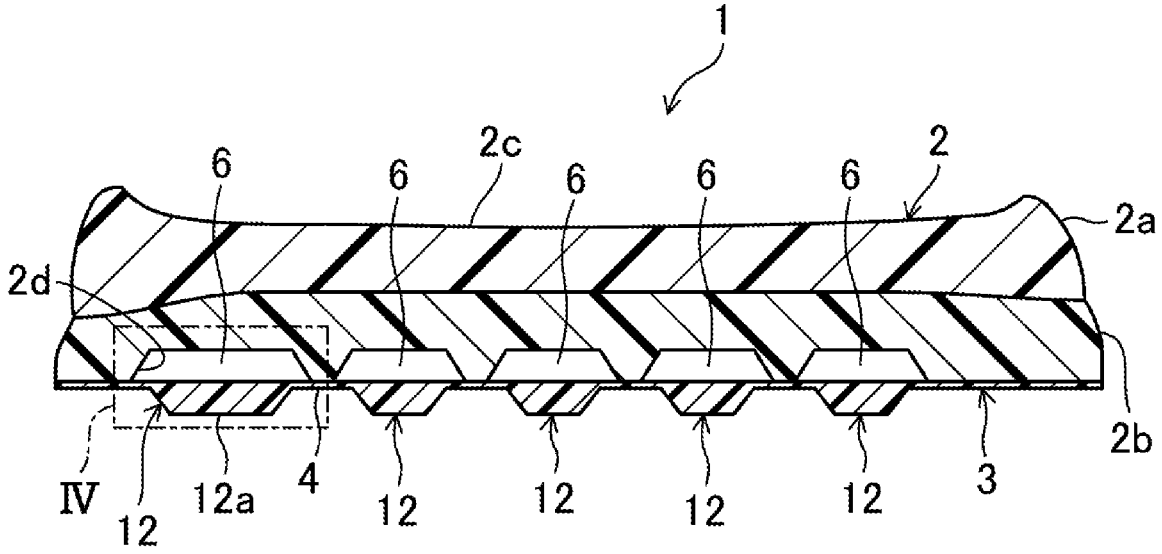
FIG. 3 is a cross-sectional view taken along line in FIG. 1.

Referring to FIG. 3, the outsole 3 illustrated therein has a substantially flat reference surface 4 formed on a lower side of the outsole 3. The reference surface 4 functions as a main ground surface at a moment when the sole structure 1 contacts the ground surface during wearer's running or walking.

A plurality of studs 12, 12, . . . having a predetermined projection height are provided on the reference surface 4 of the outsole 3 that is disposed at a position mainly corresponding to the forefoot of the wearer's foot (see FIG. 1).

Each stud 12 projects downward from the reference surface 4 and has a substantially quadrangular shape in bottom view. For example, each stud 12 is made of the same material as the outsole 3 and formed integrally with the outsole 3 such that the stud 12 is movable in the vertical direction with respect to the reference surface 4.

Figure 4:
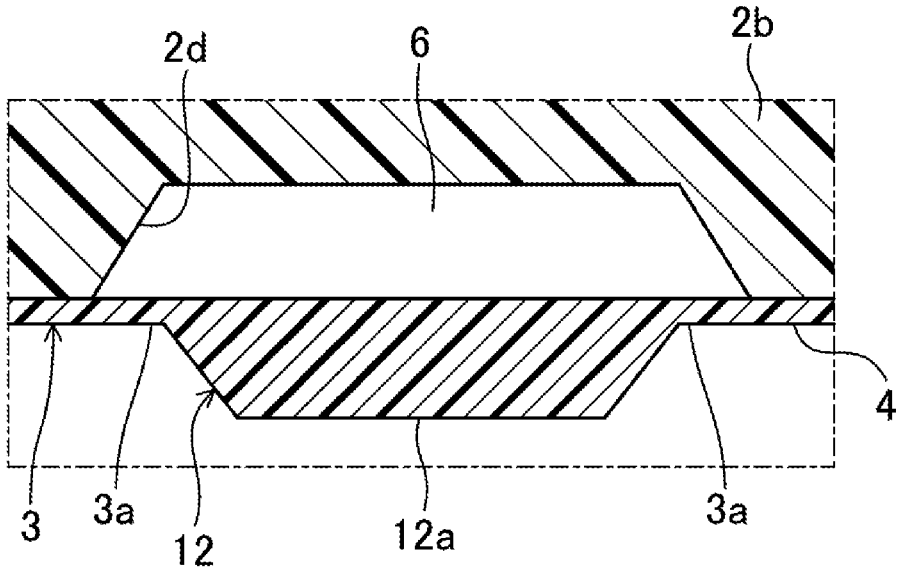
FIG. 4 is a partial cross-sectional view illustrating the portion IV in FIG. 3 on an enlarged scale.
Figure 5:
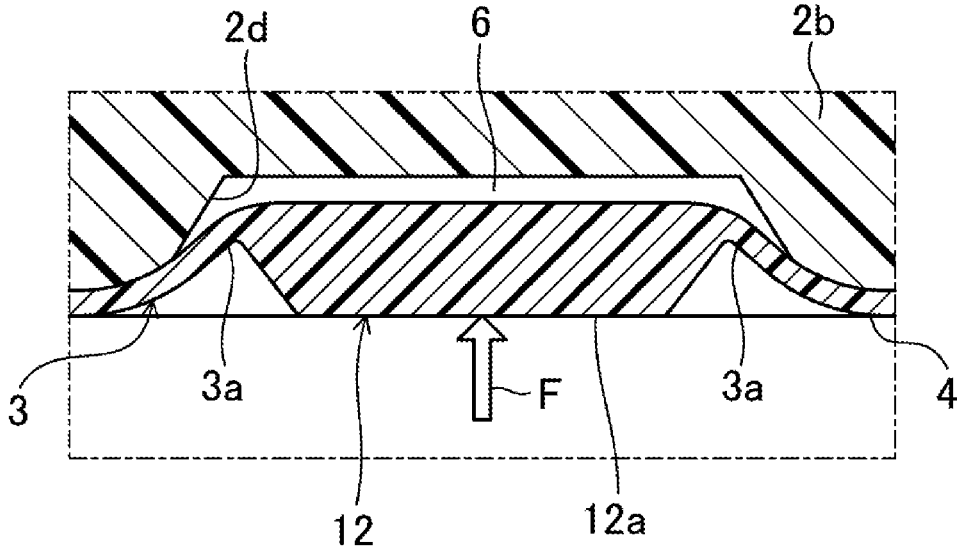
FIG. 5 corresponds to FIG. 4 and illustrates a state where an external force acts on the projection surface of a stud illustrated in FIG. 4.

As illustrated in FIGS. 3 to 5, each stud 12 is tapered downward from the reference surface 4, in cross section. Each stud 12 has a substantially flat projection surface 12*a* on its lower portion. The projection surface 12*a* has a substantially rectangular shape in bottom view (see FIG. 1).

Each stud 12 is configured to move in the vertical direction with the projection surface 12*a* coming close to the reference surface 4 when the wearer wearing shoes each including the sole structure 1 is running or walking, for example.

Specifically, as illustrated in FIG. 5, at a moment when the sole structure 1 contacts the ground, an external force F such as a repulsive force applied by the ground or the like acts on the projection surface 12*a* of the stud 12. Due to the action of the external force F, root portions 3*a*, 3*a*, of the outsole 3, which are continuous with an upper portion of the stud 12, are elastically deformed to enter the midsole hollow 6. The elastic deformation of the root portions 3*a*, 3*a* causes the stud 12 to come close to the midsole hollow 6. If the external force F keeps acting on the projection surface 12*a*, the entire stud 12 retracts into the midsole hollow 6, while maintaining its shape. As a result, the stud 12 is brought into a retraction state, in which the projection surface 12*a* is substantially coplanar with the reference surface 4 of the outsole 3 except the root portions 3*a*, 3*a*.

As can be seen, each stud 12 is configured to move, in response to an external force F acting on the projection surface 12*a*, in the vertical direction with its upper portion coming close to the associated midsole hollow 6 and with the projection surface 12*a* coming close to the reference surface 4.

When the sole structure 1 comes out of contact with the ground, the projection surface 12*a* is released from the action of the external force F, so that the root portions 3*a*, 3*a* of the outsole 3 recover to the original state. The stud 12 is thereby brought out of the retraction state and moves downward out of the midsole hollow 6 to return to the original position (i.e., the position illustrated in FIG. 4) while the projection surface 12*a* moves away from the reference surface 4 of the outsole 3 except the root portions 3*a*, 3*a*.

Effects of First Embodiment

As described above, the lower midsole 2*b* (a lower portion of the midsole 2) is provided with the midsole hollows 6, 6, . . . that are each defined between the upper portion of the outsole 3 and an associated one of the midsole recesses 2*d*, 2*d* formed in the lower surface of the lower midsole 2*b* at positions facing the upper sides of the studs 12, 12, . . . . Each midsole hollow 6 is provided directly above the associated one of the studs 12. This configuration enables each stud 12 to move in the vertical direction toward the associated midsole hollow 6 in response to an external force F, such as a repulsive force from the ground, acting on the projection surface 12*a* of the stud 12 at a moment when the sole structure 1 contacts the ground. As a result, the sole structure 1 can exhibit cushioning properties. Unlike the known technique, in the sole structure 1, it is unnecessary to form a recess, as an element enabling each stud 12 to move in the vertical direction, in an upper portion of the stud 12 by recessing the upper surface of the outsole 3. The thickness of each of the studs 12 of the sole structure 1 is therefore not particularly restricted. The studs 12 can be formed to have a relatively large thickness, making it possible to reduce or prevent deterioration with age due to, for example, the influence of abrasion of the studs 12. Thus, the sole structure 1 according to the first embodiment of the present disclosure is capable of reducing or preventing the deterioration with age such as abrasion while maintaining appropriate cushioning properties.

Each stud 12 is formed such that the surface area of its projection surface 12*a* is smaller than the opening area of the associated midsole recess 2*d*. Thus, the projection surface 12*a* comes close to the reference surface 4 in response to an external force F acting thereon, and the entire stud 12 including the projection surface 12*a* easily enters the associated midsole hollow 6. As can be seen, the vertical movement of the studs 12 is facilitated, resulting in further improvement of the cushioning properties of the sole structure 1.

Second Embodiment

Figure 6:
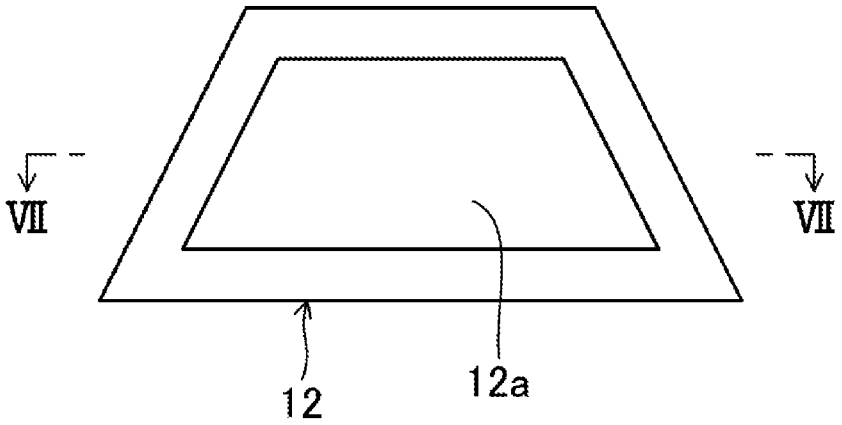
FIG. 6 is a partial bottom view schematically illustrating, on an enlarged scale, a stud of a sole structure according to a second embodiment of the present disclosure.
Figure 7:
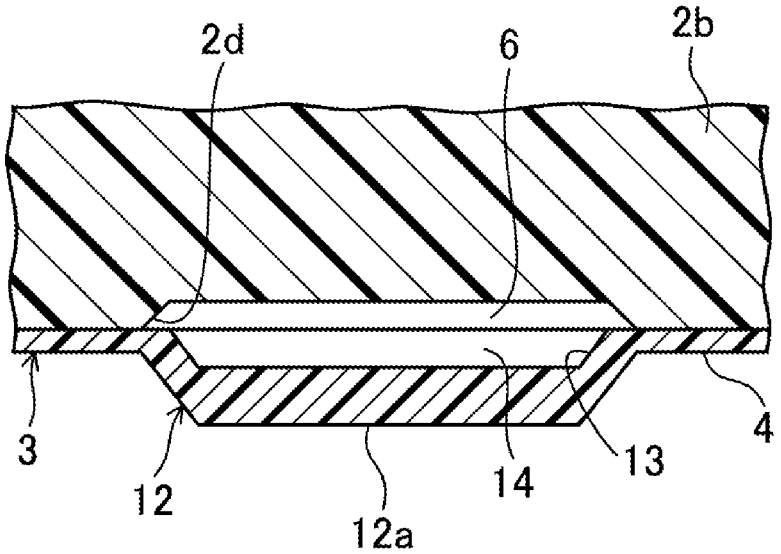
FIG. 7 is a cross-sectional view taken along line VII-VII in FIG. 6.

FIGS. 6 and 7 illustrate a sole structure 1 according to a second embodiment of the present disclosure. The second embodiment differs from the first embodiment in part of the structure of the stud 12. Note that the sole structure 1 of this embodiment is the same as the sole structure 1 of the first embodiment, except this difference. Therefore, components that are the same as those shown in FIGS. 1 to 5 are denoted by the corresponding reference characters, and a detailed description thereof is omitted herein.

As illustrated in FIG. 6, in the sole structure 1 of this embodiment, each of the studs 12 has a projection surface 12*a* formed in a substantially trapezoidal shape in bottom view. As illustrated in FIG. 7, outsole recesses 13 are provided in an upper portion of each stud 12. Each of the outsole recesses 13 is formed by recessing the upper surface of the outsole 3. Specifically, each outsole recess 13 is disposed directly above the associated projection surface 12*a*, and is tapered in a direction from the opening toward the bottom of the outsole recess 13.

Outsole hollows 14 are each defined between an associated one of the outsole recesses 13 and the lower midsole 2*b*. Each of the outsole hollows 14 is disposed in the upper portion of the associated stud 12 (i.e., directly above the associated projection surface 12*a*). Each stud 12 is formed such that the surface area of its projection surface 12*a* is smaller than the opening area of the associated outsole recess 13.

Each stud 12 of this embodiment is configured to move, in response to an external force F acting on the projection surface 12*a*, in the vertical direction while the outsole hollow 14 is compressively deformed and the projection surface 12*a* comes close to the reference surface 4. As can be seen, the vertical movement of each stud 12 of the second embodiment is further facilitated by the compressive deformation of the outsole hollow 14, as compared to the first embodiment. As a result, the cushioning properties of the sole structure 1 are further improved.

Variation of Second Embodiment

Figure 8:
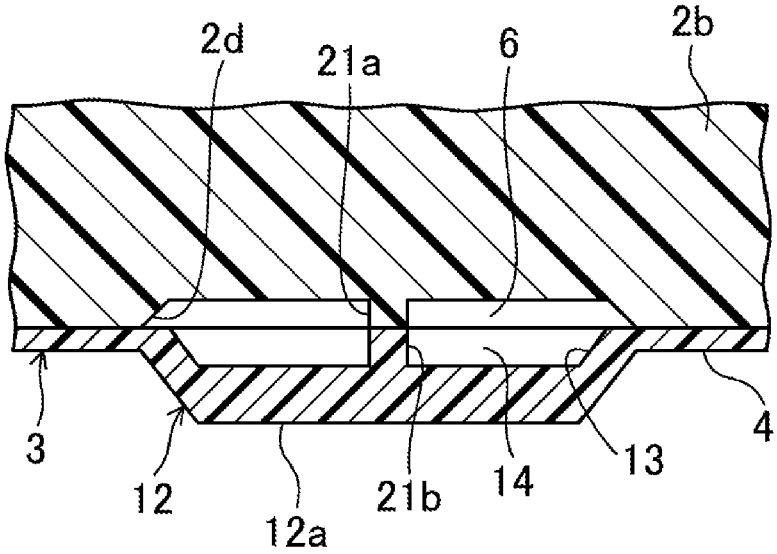
FIG. 8 corresponds to FIG. 7 and illustrates a cross-sectional structure of a stud, as a variation of the sole structure according to the second embodiment of the present disclosure.

FIG. 8 illustrates a variation of the sole structure 1 of the second embodiment. As can be seen, a midsole rib 21*a* and an outsole rib 21*b* may be provided in the midsole hollow 6 and the outsole hollow 14, respectively.

Specifically, the midsole rib 21*a* is formed integrally with the bottom of the midsole recess 2*d* and extends from the bottom toward the outsole 3.

The outsole rib 21*b* is formed integrally with the bottom of the outsole recess 13 and extends upward from the bottom toward the lower midsole 2*b*. The outsole rib 21*b* is disposed such that its upper end is in contact with the lower end of the midsole rib 21*a*.

As can be seen, the variation of the sole structure 1 of the second embodiment includes the midsole rib 21*a* and the outsole rib 21*b*. In a step of compression-bonding the outsole 3 and the lower midsole 2*b* (midsole 2) together of a production process of the sole structure 1, these ribs 21*a* and 21*b* can prevent the midsole hollow 6 and the outsole hollow 14 from being crushed unintentionally, thereby maintaining the internal spaces of these hollows.

In the produced sole structure 1, the midsole rib 21*a* and the outsole rib 21*b* can be deformed when an external force F acts on the projection surface 12*a*. The ribs 21*a* and 21*b* therefore do not hinder the outsole hollow 14 from being compressively deformed.

Other Embodiments

In the sole structure 1 of each of the embodiments described above, each stud 12 has the projection surface 12*a* formed in a substantially rectangular shape in bottom view. However, this is merely a non-limiting example. For example, the projection surface 12*a* may have a circular or triangular shape in bottom view.

In the sole structure 1 of each of the embodiments described above, each midsole recess 2*d* is tapered in the direction from the opening to the bottom. However, this is merely a non-limiting example. For example, the midsole recess 2*d* may be curved over a region from the opening to the bottom so as to have a substantial dome shape. This applies also in the case of the outsole recess 13 described in the second embodiment.

Note that the present disclosure is not limited to the embodiments described above, and various changes and modifications may be made without departing from the scope of the present disclosure.

The present disclosure is industrially applicable to, for example, walking shoes, running shoes, shoes for indoor sports, and shoes for ball sports played on soil or turf.

What is claimed is:

1. A sole structure comprising a midsole made of an elastic material, and an outsole overlaid on a lower side of the midsole, wherein the outsole includes a substantially flat reference surface formed on a lower side of the outsole, and a stud projecting downward from the reference surface and having a projection surface positioned below the reference surface, a midsole hollow is provided in a lower portion of the midsole, the midsole hollow defined between an upper portion of the outsole and a midsole recess formed in a lower surface of the midsole at a position facing an upper side of the stud, an outsole hollow is provided in an upper portion of the stud, the outsole hollow defined between a lower portion of the midsole and an outsole recess formed in an upper surface of the outsole, a midsole rib is provided in the midsole hollow, the midsole rib extending downward from a bottom of the midsole recess toward the outsole, an outsole rib is provided in the outsole hollow, the outsole rib extending upward from a bottom of the outsole recess toward the midsole and being in contact with a lower end of the midsole rib, and the stud is configured to move, in response to an external force acting on the projection surface, in the vertical direction while the outsole hollow is compressively deformed and the projection surface comes close to the reference surface.

2. The sole structure of claim 1, wherein the stud is formed such that a surface area of the projection surface is smaller than an opening area of the midsole recess.

3. A shoe comprising the sole structure of claim 1.

4. A shoe comprising the sole structure of claim 2.

* * * * *